US008851604B2

(12) United States Patent
Akune et al.

(10) Patent No.: US 8,851,604 B2
(45) Date of Patent: Oct. 7, 2014

(54) INK-JET RECORDING APPARATUS

(71) Applicants: Junichirou Akune, Sagamihara (JP); Kumiko Furuno, Kokubunji (JP)

(72) Inventors: Junichirou Akune, Sagamihara (JP); Kumiko Furuno, Kokubunji (JP)

(73) Assignee: Konica Minolta IJ Technologies, Inc., Tokyo (JP)

( * ) Notice: Subject to any disclaimer, the term of this patent is extended or adjusted under 35 U.S.C. 154(b) by 0 days.

(21) Appl. No.: 13/794,505

(22) Filed: Mar. 11, 2013

(65) Prior Publication Data

US 2013/0241984 A1 Sep. 19, 2013

(30) Foreign Application Priority Data

Mar. 14, 2012 (JP) ..... 2012-058004

(51) Int. Cl.
*B41J 29/38* (2006.01)
*B41J 2/045* (2006.01)

(52) U.S. Cl.
CPC ..... *B41J 2/04588* (2013.01); *B41J 2/04581* (2013.01)
USPC ..... 347/10; 347/69

(58) Field of Classification Search
CPC ..... B41J 2/04581; B41J 2/04588; B41J 2002/14266; B41J 2/14233
USPC ..... 347/9–11, 68–72
See application file for complete search history.

(56) References Cited

U.S. PATENT DOCUMENTS

| | | | | |
|---|---|---|---|---|
| 7,055,921 | B2 * | 6/2006 | Sumi | 347/10 |
| 7,896,456 | B2 * | 3/2011 | Iwashita et al. | 347/10 |
| 8,308,258 | B2 | 11/2012 | Iriguchi | |
| 8,534,802 | B2 * | 9/2013 | Miyazawa et al. | 347/68 |
| 2004/0155915 | A1 | 8/2004 | Kitami et al. | |
| 2010/0118073 | A1 | 5/2010 | Kitami et al. | |

FOREIGN PATENT DOCUMENTS

| | | | |
|---|---|---|---|
| EP | 2 184 168 | A1 | 5/2010 |
| JP | 2001-205826 | A | 7/2001 |
| JP | 2011-005815 | A | 1/2011 |

OTHER PUBLICATIONS

Extended European Search Report (EESR) dated Jul. 9, 2013 (in English) in counterpart European Application No. 13158485.6.

* cited by examiner

*Primary Examiner* — An Do
(74) *Attorney, Agent, or Firm* — Holtz Holtz Goodman & Chick PC

(57) ABSTRACT

A driving waveform has a first driving waveform (PLSTM1) composed of non-GND waveform, a second driving waveform (PLSTM2) composed of a non-GND waveform different from the first driving waveform, and a third driving waveform (PLSTM0) composed of a GND waveform, and a driving voltage V1 of the first driving waveform and a driving voltage V2 of the second driving waveform is |V1|>|V2|; and the driving circuit selects at least the first driving waveform and the second driving waveform or only the first driving waveform at every predetermined time in 1 pixel cycle in accordance with the discharge data, applies this to one of the two driving electrodes of the pressure generating unit and also applies only the second driving waveform to the other so as to operate the pressure generating unit by a differential waveform between the two driving electrodes.

6 Claims, 11 Drawing Sheets

| STB-n | STB-n | STB-n | IMAGE DATA | DRIVING WAVEFORM PATTERN DATA | | | | |
|---|---|---|---|---|---|---|---|---|
| | | | | 4 | 3 | 2 | 1 | 0 |
| n=1 | n=2 | n=3 | 0 | 2 | 2 | 2 | 2 | 0 |
| n=1 | n=2 | n=3 | 1 | 2 | 0 | 1 | 0 | 0 |
| n=1 | n=2 | n=3 | 2 | 1 | 1 | 1 | 1 | 0 |
| n=2,3 | n=1,3 | n=1,2 | any | 2 | 2 | 2 | 2 | 0 |
| out-D | | | NONE | 2 | 2 | 2 | 2 | 0 |

INK-JET RECORDING APPARATUS

TECHNICAL FIELD

The present invention relates to an ink-jet recording apparatus and more particularly to an ink-jet recording apparatus capable of discharging dots with different droplet sizes every pixel cycle with a simple driving circuit configuration without a wastefully long driving cycle.

BACKGROUND

An ink-jet recording apparatus which records an image by using an ink-jet recording head (hereinafter referred to as a recording head) which discharges micro ink droplets from a nozzle discharges the ink droplets from the nozzle by giving a pressure through operation of pressure generating unit to ink in a pressure chamber and has them land on a recording medium such as recording sheets. As the pressure generating unit, a piezoelectric material such as PZT which is electric/mechanical converting unit is used in general. The piezoelectric material is sandwiched by two driving electrodes and is subjected to deformation driving by having a driving waveform with a predetermined voltage applied between these driving electrodes, and this deformation driving expands/contracts the capacity in the pressure chamber so as to give a pressure to the ink in the pressure chamber for discharge.

Such ink-jet recording method is capable of highly accurate image recording with a relatively simple configuration and has been rapidly developed in a wide variety of fields from household to industry. Particularly for higher speed and higher image qualities, various improvements have been proposed, and there is a high demand for high-speed printing by using a recording head such as one-pass printing using a line head and the like, while there is also a demand for higher image quality by improving gradation of printed images.

Also, JP-A-2011-5815 or JP-A-2001-205826 discloses technologies relating to the gradation include an ink-jet recording apparatus which realizes multi-gradation by selecting dots having different droplet sizes in every pixel cycle In JP-A-2011-5815, as illustrated in FIG. 13, dedicated driving waveforms for the respective droplet sizes are prepared and used in accordance with the desired droplet size to be discharged within 1 pixel cycle T. (a) in the figure illustrates a driving waveform used when small dots are to be discharged, (b) is a driving waveform used when medium dots are to be discharged, and (c) is a driving waveform when large dots are to be discharged.

In JP-A-2001-205826, as illustrated in FIG. 14, for example, a driving waveform in which a plurality of types of waveforms having shapes different from each other are sequentially generated in a predetermined order for each pixel cycle T is prepared, and a portion to be used at discharge (portion where a switch circuit is turned on) in the driving waveform in which the plurality of types of the waveforms are juxtaposed is selected in accordance with the desired droplet size to be discharged so that dots having different sizes can be printed individually. For example, (a) in the figure illustrates the entire driving waveform generated in 1 pixel cycle T (sections Ta to Tf), (b) forms a small dot by turning on only the waveform portions in the sections Ta and Te among them, (c) forms medium dots by turning on only the waveform portion in the section Tc, and (d) forms large dots by turning on only the waveform portion in the section Tf.

JP-A-2011-5815 has a problem that a burden on a driving circuit is large since the dedicated driving waveforms which are different depending on the droplet size are individually needed.

On the other hand, in JP-A-2001-205826, the common driving waveform illustrated in FIG. 14(a) can be used for different droplet sizes, but when an ink droplet is to be discharged actually, only a portion in the entire driving waveform is used in 1 pixel cycle T. Thus, time for the unused waveform portion is wasted, and the driving cycle is prolonged for that portion, which is a serious problem in high-speed printing.

SUMMARY OF THE INVENTION

The present invention has been made in view of the aforementioned problems. The object of the present invention is to provide an ink-jet recording apparatus capable of discharging dots having different sizes every pixel cycle with a simple driving circuit configuration without a wastefully long driving cycle by selecting and using separate driving waveforms from a plurality of types of driving waveforms having different shapes for two driving electrodes for operating pressure generating unit, respectively, for every predetermined time in 1 pixel cycle so that the pressure generating unit is operated by its differential waveform.

To achieve the abovementioned object, an inkjet recording apparatus reflecting one aspect of the present invention are:

An ink-jet recording apparatus comprising: a recording head that includes a plurality of nozzles for discharging ink droplets, a pressure chamber communicating with each of the nozzles, and a pressure generating unit having a piezoelectric material sandwiched between two driving electrodes and operated by application of the driving waveform to each of the driving electrodes on the basis of discharge data so as to change the capacity of the pressure chamber and to discharge ink in the pressure chamber from the nozzle; and a driving circuit that generates the driving waveform, wherein the driving waveform has a first driving waveform composed of non-GND waveform, a second driving waveform composed of a non-GND waveform different from the first driving waveform, and a third driving waveform composed of a GND waveform, and a driving voltage V1 of the first driving waveform and a driving voltage V2 of the second driving waveform is $|V1|>|V2|$; and the driving circuit selects at least the first driving waveform and the second driving waveform or only the first driving waveform at every predetermined time in 1 pixel cycle in accordance with the discharge data, applies this to one of the two driving electrodes of the pressure generating unit and also applies only the second driving waveform to the other so as to operate the pressure generating unit by a differential waveform between the two driving electrodes.

Preferably, the driving circuit has a first storage unit for storing discharge data and a second storage unit for storing information specifying a relationship between the discharge data and the driving pattern corresponding to the first driving waveform, the second driving waveform, and the third driving waveform for operating the pressure generating unit.

Preferably, the second storage unit is rewritable.

Preferably, the first driving waveform and the second driving waveform are both rectangular waves.

Preferably, the recording head is a shear-mode type recording head having a common partition wall made of a piezoelectric material between the adjacent pressure chambers, the driving electrode being formed on the surface of the partition wall faced in the pressure chamber, and shear deformation being performed by the partition wall as the pressure generating unit.

Preferably, the driving circuit has all the pressure chambers grouped into a plurality of sets, one set being composed of mutually adjacent three pressure chambers, and the partition wall is subjected to shear deformation so that the three pressure chambers in each set are sequentially driven in a time division manner.

DESCRIPTION OF THE PREFERRED EMBODIMENTS

The present invention will be described below in detail however the present invention is not limited by the description below.

Figure 1:
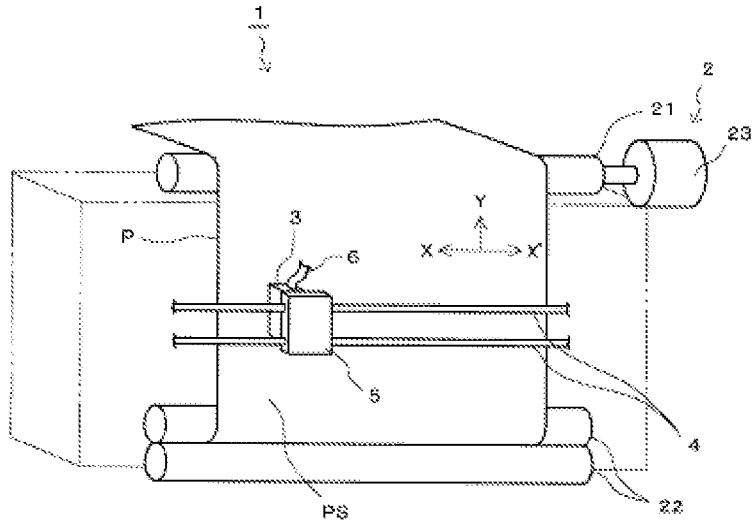
FIG. 1 is a diagram illustrating a schematic configuration of an ink-jet recording apparatus according to the present invention.

FIG. 1 is a diagram illustrating a schematic configuration of an ink-jet recording apparatus according to the present invention.

In the ink-jet recording apparatus 1, a recording medium P is sandwiched between a pair of conveying rollers 22 of a conveying mechanism 2 and moreover, conveyed by a conveying roller 21 rotated and driven by a conveying motor 23 in a Y direction in the figure (vertical scanning direction).

A recording head 3 is provided between the conveying roller 21 and the pair of conveying rollers 22 so as to oppose a recording surface PS of the recording medium P. This recording head 3 is arranged and mounted on a carriage 5 provided capable of reciprocating movement by driving unit, not shown, along a guide rail 4 extended over the a width direction of the recording medium P in a X-X' direction (horizontal scanning direction) in the figure substantially orthogonal to the conveying direction (vertical scanning direction) of the recording medium P so that a nozzle surface side is opposed to the recording surface PS of the recording medium P and is electrically connected to a driving signal generating unit 100 (See FIG. 4) provided in a driving circuit, which will be described later, through a flexible cable 6.

The recording head 3 is configured to scan and move on the recording surface PS of the recording medium P in the X-X' direction in the figure with the movement of the carriage 5 in the main scanning direction and to record a desired ink-jet image by discharging ink droplets from the nozzle in a process of this scanning movement.

Figure 2:
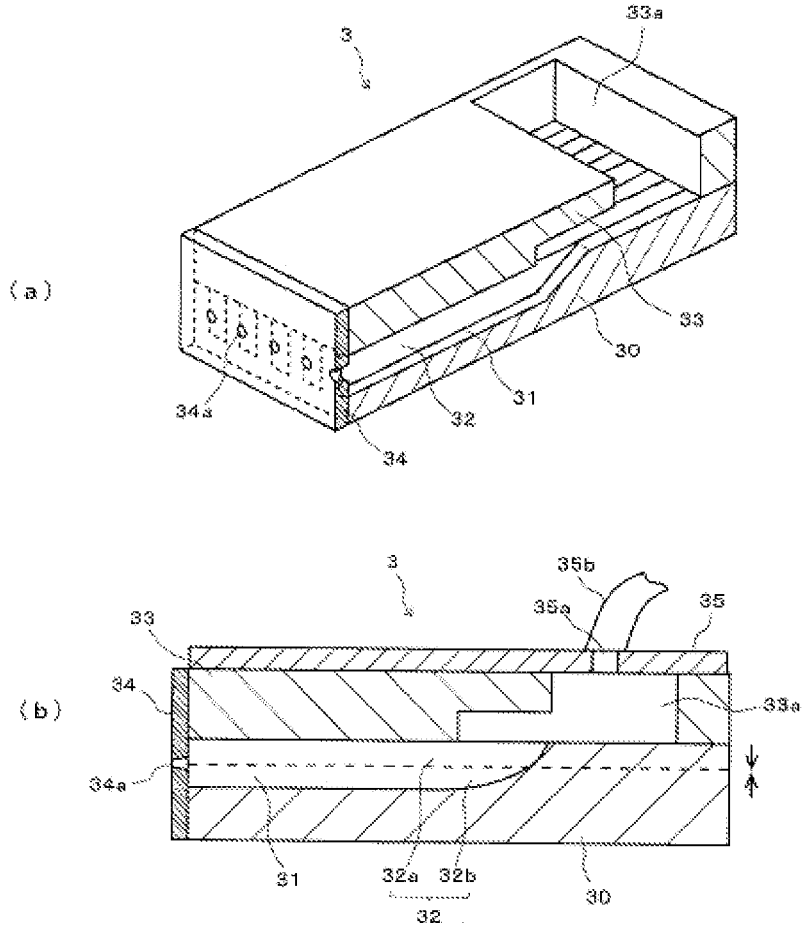
FIG. 2 are diagrams illustrating an example of a recording head 3, in which FIG. 2(*a*) is a perspective view illustrating an appearance in section, and FIG. 2(*b*) is a sectional view when seen from a side face.

FIG. 2 are diagrams illustrating an example of the recording head 3, in which FIG. 2(*a*) is a perspective view illustrating an appearance in section and FIG. 2(*b*) is a sectional view when seen from a side face.

In the recording head 3, reference numeral 30 denotes a channel substrate. On the channel substrate 30, a large number of thin-groove shaped channels 31 and a partition wall 32 are juxtaposed alternately. On the upper surface of the channel substrate 30, a cover substrate 33 is provided so as to cover the upper part of all the channels 31.

On the end surfaces of the channel substrate 30 and the cover substrate 33, a nozzle plate 34 is joined, and a nozzle surface is formed by the surface of this nozzle plate 34. One end of each channel 31 communicates with the outside through a nozzle 34*a* formed on this nozzle plate 34.

The other end of each channel 31 gradually becomes a shallow groove with respect to the channel substrate 30 and communicates with a common channel 33*a* common to each channel 31 opened and formed in the cover substrate 33. The common channel 33*a* is further closed by a plate 35, and ink is supplied into the common channel 33*a* and each channel 31 from an ink supply pipe 35*b* through an ink supply opening 35*a* formed in the plate 35.

Each partition wall 32 is made of a piezoelectric material such as PZT which is an electric/mechanical converting unit. Here, both an upper wall portion 32*a* and a lower wall portion 32*b* are formed of a piezoelectric material subjected to polarization processing, and the upper wall portion 32*a* and the lower wall portion 32*b* have polarization directions opposite to each other (illustrated by arrows in FIG. 2(*b*)) in exemplification, but a portion formed by a piezoelectric material subjected to polarization processing may be only the portion indicated by reference numeral 32*a*, for example, and it is only necessary that it is formed in at least a part of the partition wall 32. The partition wall 32 is juxtaposed alternately with the channel 31. Therefore, one partition wall 32 is shared by the both adjacent channels 31 and 31.

In each channel 31, a driving electrode (not shown in FIG. 2) is formed from the wall surfaces of the both partition walls 32 to the bottom surface of the channel 31, respectively, and by applying a driving pulse having a predetermined voltage respectively from the driving signal generating unit provided in the driving circuit, which will be described later, to the both driving electrodes sandwiching the partition wall 32, the partition wall 32 made of the piezoelectric material is flexed and deformed from the joint surface between the upper wall portion 32*a* and the lower wall portion 32*b*. By means of this flexion deformation of the partition wall 32, a pressure wave is generated in the channel 31, and a pressure is given to the ink in the channel 31 to be discharged from the nozzle 34*a*. Therefore, this recording head 3 is a shear-mode type recording head in which a pressure chamber in the present invention is composed of an inside of the channel 31 surrounded by the channel substrate 30, the cover substrate 33, and the nozzle plate 34, the pressure generating unit in the present invention is composed of the partition wall 32 made of the piezoelectric material and the driving electrode on the surface thereof, and an ink droplet is discharged by shear deformation of this partition wall 32.

The driving signal generating unit provided in the driving circuit electrically connected to this recording head 3 through the flexible cable 6 generates a driving waveform to be applied to one pixel cycle in order to have an ink droplet discharged. Here, a driving waveform is generated in order to express gradation by discharging a large droplet (large dot) and a small droplet (small dot) from the same nozzle 34*a*.

Figure 3:
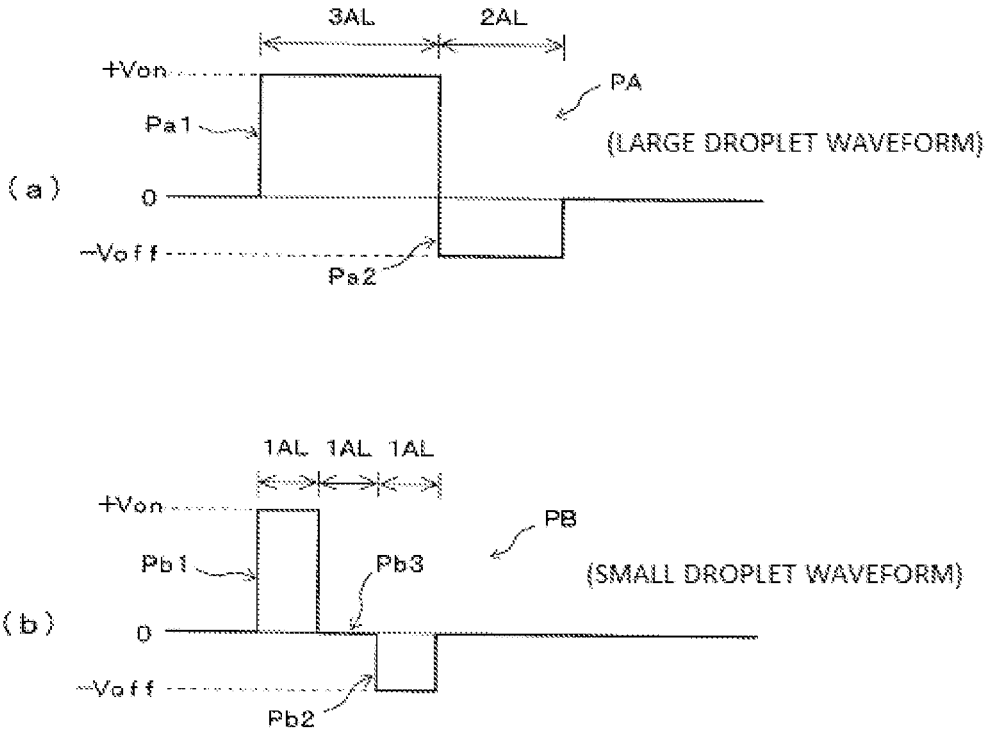
FIG. 3(*a*) is a diagram illustrating a basic configuration of a waveform of a large droplet and FIG. 3(*b*) for a waveform of a small droplet, respectively.
Figure 4:
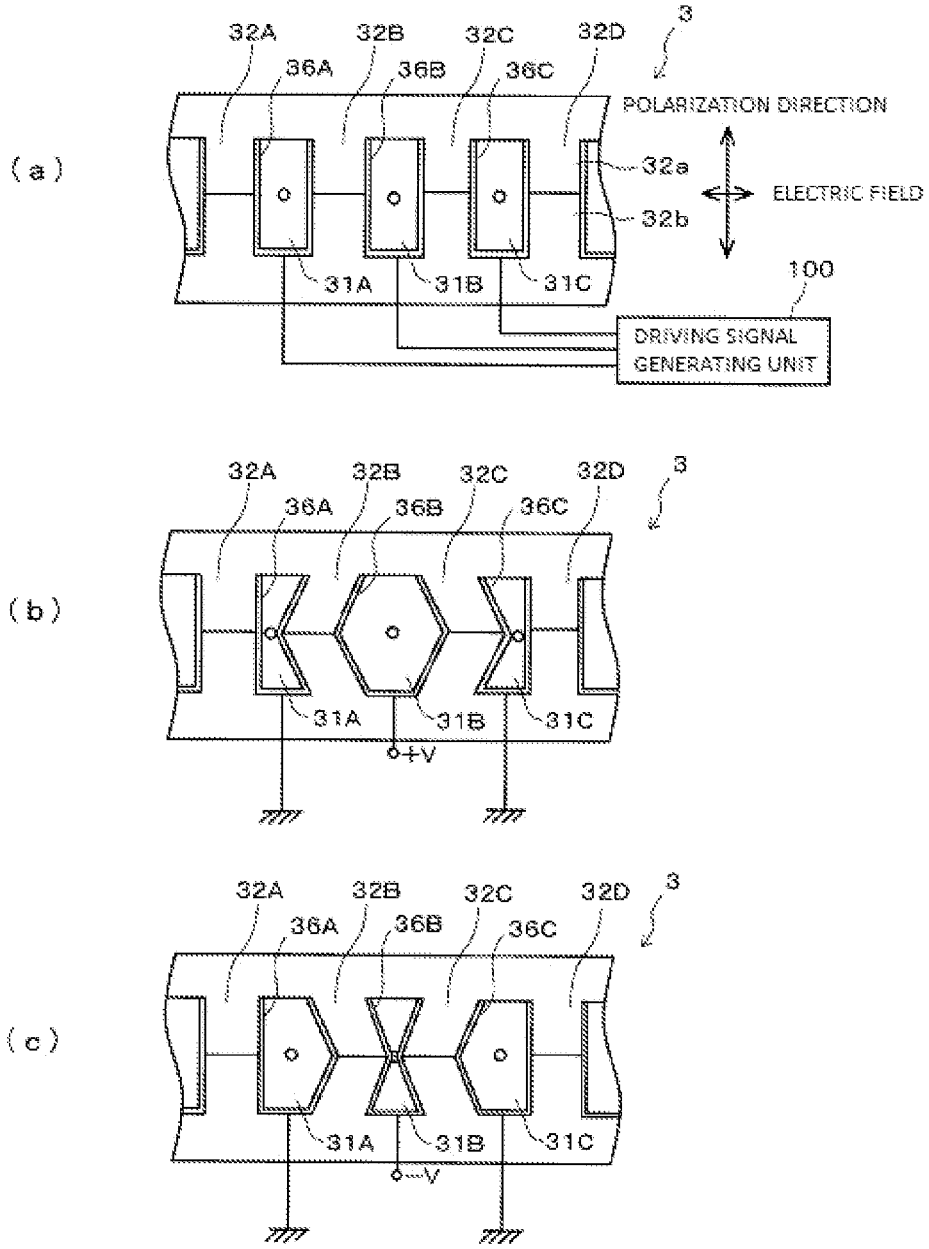
FIG. 4 are explanatory diagrams of an ink discharging operation of the recording head when discharging the large droplet waveform and the small droplet waveform.

An example of the driving waveform for discharging the large droplet and the small droplet will be described by using FIG. 3. FIG. 3(*a*) illustrates a basic configuration of a large droplet waveform for discharging a large droplet, and FIG. 3(*b*) illustrates a basic configuration of a small droplet waveform for discharging a small droplet. Moreover, an ink discharging operation of the recording head 3 when the large droplet waveform and the small droplet waveform are applied will be described by using FIG. 4. FIG. 4 illustrate a part of a section when the recording head 3 is cut in a direction orthogonal to a length direction of the channel.

A large droplet waveform PA is composed of a rectangular wave including an expanding pulse Pa1 having a 3AL width for expanding the capacity of the channel and a contracting pulse Pa2 having a 2AL width for contracting the capacity of the channel.

Here, AL (Acoustic Length) refers to ½ of an acoustic resonance cycle of a pressure wave in the channel. The AL is acquired as a pulse width at which a flying speed of an ink droplet becomes the maximum when a speed of an ink droplet discharged at application of a rectangular-wave driving pulse to the driving electrode is measured and the rectangular-wave pulse width is changed while a voltage value of the rectangular wave is made constant.

Moreover, the pulse is a rectangular wave having a constant voltage crust value and assuming that 0V is 0% and the crust value voltage is 100%, the pulse width is defined as time between a rise 10% from the 0V voltage to a fall 10% from the crust value voltage.

Moreover, the rectangular wave refers to such a waveform that rising time and falling time between 10% and 90% of the voltage are both within ½ or preferably within ¼ of AL.

In the present invention, the driving waveform for discharging the large droplet and the small droplet, respectively, is preferably in a mode of a rectangular wave as above. Particularly, in the shear-mode type recording head 3 illustrated in this embodiment, since the ink droplet is discharged from the nozzle 34*a* by using resonance of the pressure wave generated in the channel 31, the ink droplet can be discharged more efficiently by using a rectangular wave.

Moreover, the shear-mode type recording head 3 has a fast meniscus response to application of the driving waveform composed of a rectangular wave, and the driving voltage can be kept low. Since a voltage is applied all the time to the recording head 3 whether it is discharge or non-discharge in general, a low driving voltage is important in suppressing heat generation in the head and stable injection of ink droplets.

Moreover, since the rectangular wave can be generated easily by using a simple digital circuit, it has an advantage that circuit configuration can be simplified as compared with use of a trapezoidal wave having a ramp wave.

The expanding pulse Pa1 in the large droplet waveform PA is a pulse which applies a predetermined positive driving voltage +Von to the driving electrode 36B faced in a channel 31B discharging the ink droplet. As illustrated in FIG. 4(*a*), if a driving pulse is not applied to none of the driving electrodes 36A, 36B and 36C in the channels 31A, 31B, and 31C adjacent to one another, none of the partition walls 32A, 32B, 32C and 32D is deformed and in a neutral state, but if the driving electrodes 36A and 36C are grounded and also the expanding pulse Pa1 is applied to the driving electrode 36B in this neutral state, an electric field is generated in a direction orthogonal to the polarization direction of the piezoelectric material constituting the partition walls 32B and 32C. As a result, shear deformation is generated on the joint surface between the upper wall portion 32*a* and the lower wall portion 32*b*, respectively, in each of the partition walls 32B and 32C, and as illustrated in FIG. 4(*b*), the partition walls 32B and 32C are flexed and deformed outward from each other and the capacity of the channel 31B is enlarged. By means of this flexion deformation, a negative pressure wave is generated in the channel 31B, and ink flows therein.

Since the pressure in the channel 31B is inverted at every 1AL, the inside of the channel 31B after 3AL has elapsed has a positive pressure, and the contracting pulse Pa2 is applied to the driving electrode 36B at this timing.

The contracting pulse Pa2 is a pulse which applies a negative driving voltage −Voff continuously to end of application of the expanding pulse Pa1 without an idle period. By applying this driving voltage −Voff to the driving electrode 36B continuously to the expanding pulse Pa1, movements of the partition walls 32B and 32C at this time changes at once from deformation outward as illustrated in FIG. 4(*b*) to deformation inward as illustrated in FIG. 4(*c*). As a result, by being added to a positive pressure caused by falling of the expanding pulse Pa1, a large pressure is further given into the channel 31B, and a relatively large ink droplet is discharged from the nozzle. The contracting pulse Pa2 returns to 0 potential after 2AL, and the pressure wave remaining is canceled due to return of the deformation of the partition walls 32B and 32C to the neutral state in FIG. 4(*a*).

On the other hand, the small droplet waveform PB is made of a rectangular wave including an expanding pulse Pb1 having a 1AL width for expanding the capacity of the channel and a contracting pulse Pb2 having a 1AL width for contracting the capacity of the channel and has an idle period Pb3 during which the 0 potential not deforming the partition wall is continued having a 1AL width between this expanding pulse Pb1 and the contracting pulse Pb2.

The expanding pulse Pb in the small droplet waveform PB is a pulse which applies a predetermined positive driving voltage +Von to the driving electrode 36B faced in a channel 31B discharging the ink droplet. In the neutral state illustrated in FIG. 4(*a*), by grounding the driving electrodes 36A and 36C and also applying the expanding pulse Pb1 to the driving electrode 36B, the partition walls 32B and 32C are flexed and deformed outward from each other as illustrated in FIG. 4(*b*), similarly to the above, and the capacity of the channel 31B is enlarged. By means of this flexion deformation, a negative pressure wave is generated in the channel 31B, and ink flows therein.

Since the pressure in the channel 31B is inverted to a positive pressure after 1AL, by returning the driving electrode 36B to 0 potential at this timing, the partition walls 32B and 32C return from the enlarged position illustrated in FIG. 4(*b*) to the neutral state illustrated in FIG. 4(*a*), and a pressure for discharge into the channel 31B is given. Since the partition walls 32B and 32C merely return to the neutral state at this time, only a small pressure as compared with the large droplet waveform PA is given into the channel 31B. As a result, a relatively small ink droplet is discharged from the nozzle.

The contracting pulse Pb2 is a pulse which places the idle period Pb3 for continuing the 0-potential state for 1AL after the end of the application of the expanding pulse Pb1 and then, applies the negative driving voltage −Voff. When the idle period Pb3 for 1AL is finished after the end of the application of the expanding pulse Pb1, the partition walls 32B and 32C are still in the neutral state as illustrated in FIG. 4(*a*), but the pressure in the channel 31B has become a negative pressure. By applying the contracting pulse Pb2 to the driving electrode 36B at this timing, the partition walls 32B and 32C are deformed inward, whereby a positive pressure is given into the channel 31B in the negative pressure state and as the result of further return to the neutral state after 1AL, the remaining pressure wave in the channel 31 is cancelled.

In the above description, the pulse width of the expanding pulse Pa1 in the large droplet waveform PA is assumed to be 3AL, but it may be within a range from 2.8 AL or more to 3.4 AL or less. Moreover, the pulse width of the expanding pulse Pb1 in the small droplet waveform PB is not limited to 1 AL but may be within a range of 0.8 AL or more and 1.2 AL or less.

Moreover, as illustrated in this embodiment, by setting the pulse width of the contracting pulse Pa2 of the large droplet waveform PA to 2AL and the pulse width of each of the expanding pulse Pb1 of the small droplet waveform PB, the idle period Pb3, and the contracting pulse Pb2 to 1AL, respectively, the pulse width of the entire driving waveform can be made small. Since the pulse width can be made small, the driving waveform can be applied in a shorter period by that, which is more preferable in realization of high-speed printing.

It is preferable that the driving voltage +Von of the expanding pulse Pa1 of the large droplet waveform PA has the same voltage as the driving voltage +Von of the expanding pulse Pb1 of the small droplet waveform PB and also, the driving voltage −Voff of the contracting pulse Pa2 of the large droplet waveform PA has the same voltage as the driving voltage −Voff of the contracting pulse Pb2 of the small droplet waveform PB. Since only one power source is required for the driving signals of the large droplet and the small droplet, the configurations of the driving circuit and the control circuit can be simplified.

The deformation of the partition wall 32 constituting the pressure generating unit is caused by a voltage difference between the two driving electrodes provided so as to sandwich the partition wall. For example, in the case of the partition wall 32B illustrated in FIG. 4, the voltage difference is generated by applying the driving waveform composed of the positive voltage (+Von) and the negative voltage (−Voff) illustrated in FIG. 3 to the one driving electrode 36B and by grounding the other driving electrode 36A. In the present invention, different driving waveforms are applied to the two driving electrodes provided so as to sandwich the partition wall 32 as above, respectively, and driving is realized by actively using the differential waveform of the driving waveforms.

Figure 5:
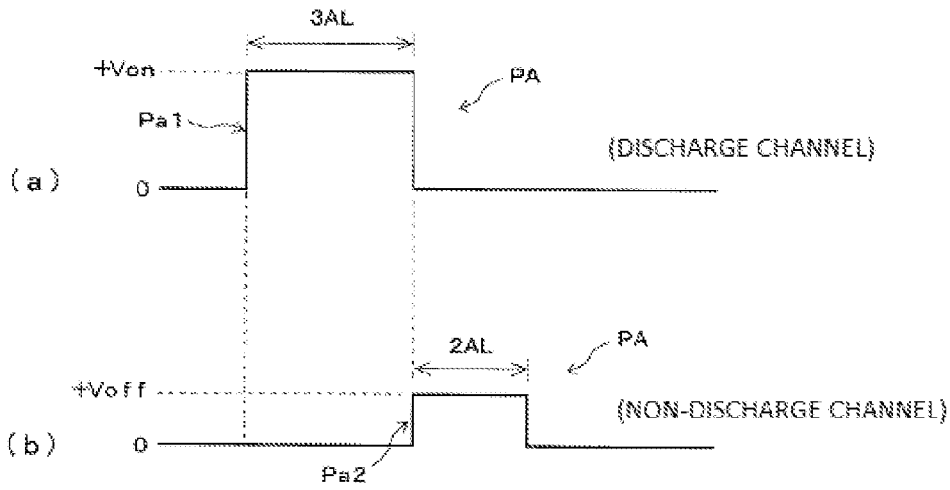
FIG. 5 are diagrams illustrating a case where the large droplet is discharged using a differential waveform.

In this case, the large droplet waveform PA whose polarity is switched to positive/negative as illustrated in FIG. 3(*a*) can be divided into waveform components, each having a single polarity, that is, a waveform PA1 for discharge channel (FIG. 5(*a*)) having a positive voltage (+Von) to be applied to a driving electrode in the discharge channel for discharging an ink droplet and a waveform PA2 for non-discharge (FIG. 5(*b*)) having a positive voltage (+Voff) to be applied to the driving electrode in the non-discharge channel on the both adjacent sides.

Assuming that the channel 31B in FIG. 4 is a discharge channel, for example, by applying the waveform PA1 for discharge channel including only the expanding pulse Pa1 having the positive voltage (+Von) illustrated in FIG. 5(*a*) to the driving electrode 36B faced in this channel 31B and the waveform PA2 for non-discharge channel including only the contracting pulse Pa2 having the positive voltage (+Voff) illustrated in FIG. 5(*b*) to the driving electrodes 36A and 36C faced in the channels 31A and 31C on the both adjacent sides which are non-discharge channels, the partition walls 32B and 32C are deformed and driven by the differential waveform between the driving electrodes 36A and 36B and the driving electrodes 36B and 36C on the both surfaces thereof completely similarly to the case where the driving waveform PA in FIG. 3(*a*) is applied only to the driving electrode 36B and the driving electrodes 36A and 36C are grounded so that the large droplet can be discharged.

Figure 6:
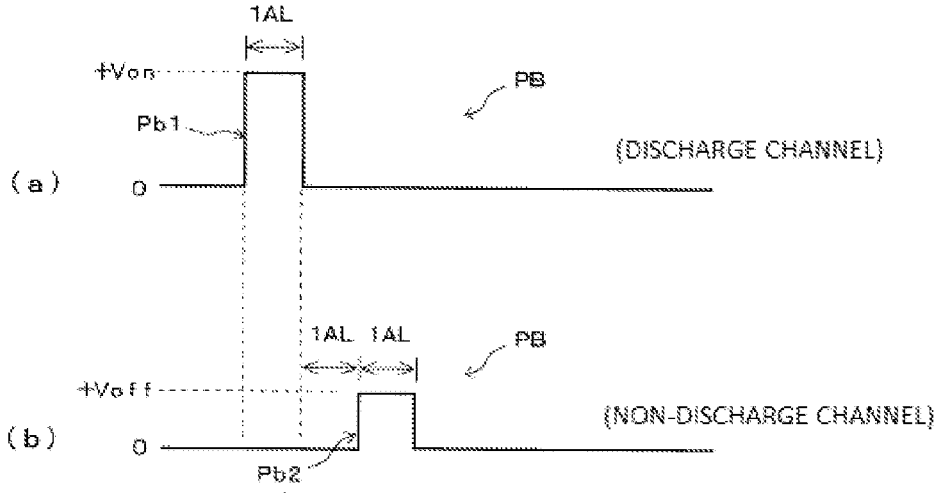
FIG. 6 are diagrams illustrating a case where the small droplet is discharged using the differential waveform.

Similarly, the small droplet waveform PB whose polarity is switched to positive/negative as illustrated in FIG. 3(*b*) can be divided into waveform components, each having a single polarity, that is, a waveform PB 1 for discharge channel (FIG. 6(*a*)) having a positive voltage (+Von) to be applied to a driving electrode in the discharge channel for discharging an ink droplet and a waveform PB2 for non-discharge channel (FIG. 6(*b*)) having a positive voltage (+Voff) to be applied to the driving electrode in the non-discharge channel on the both adjacent sides.

If the small droplet waveform PB is to be similarly applied to the channel 31B, by applying the waveform PB1 for discharge channel including only the expanding pulse Pb1 having a positive voltage (+Von) illustrated in FIG. 6(*a*) to the driving electrode 36B faced in this channel 31B and by applying the waveform PB2 for non-discharge channel including only the contracting pulse Pb2 having a positive voltage (+Voff) illustrated in FIG. 6(*b*) to the driving electrodes 36A and 36C faced in the channels 31A and 31C which are non-discharge channels on the both sides adjacent thereto, the partition walls 32B and 32C are deformed and driven by the differential waveform between the driving electrodes 36A and 36B and the driving electrodes 36B and 36C on the both surfaces thereof completely similarly to the case where the driving waveform PB in FIG. 3(*b*) is applied only to the driving electrode 36B and the driving electrodes 36A and 36C are grounded so that the small droplet can be discharged.

By configuring the partition wall 32 constituting the pressure generating unit so as to be deformed using the differential waveform when a different driving waveform is applied as above, the driving waveforms for discharging the large droplet and the small droplet can be composed only of the positive voltages (+Von, +Voff), here, and the driving circuit can be simplified.

As in this embodiment, if the recording head 3 in which a plurality of the channels 31 separated by the partition walls 32 constituting the pressure generating unit are juxtaposed is to be driven, if the partition wall 32 of one channel 31 makes a discharging operation, the channels 31 on the both adjacent sides are affected. In this case, every other channel, that is, the channels 31A and 31C in FIG. 4, for example, are used as channels exclusively for non-discharge (also referred to as dummy channels or air channels) not discharging ink droplets and can be driven using an independent driving method in which discharge is made from the channel 31B all the time, but in general, a 3-cycle driving method is used in which all the channels 31 are grouped into a plurality of sets, each set being composed of adjacent three channels in the plurality of channels 31 and the three channels in each set are sequentially driven in a time-division manner.

The separate injecting operation of the large droplet and the small droplet using the differential waveform will be described for the case of discharging operation using this 3-cycle driving method by referring to FIGS. 7 to 9.

Regarding the recording head 3 when the 3-cycle driving method is used, every two channels 31 are made into a group and all the channels 31 are divided into three groups of A, B, and C (they are referred to as A-phase, B-phase, and C-phase), but here, the mutually adjacent 9 channels 31, that is, A1, B1, C1, A2, B2, C2, A3, B3, and C3 will be described. Moreover, a timing chart of the driving waveform to be applied to the driving electrode (not shown in FIGS. 7 to 9) in each channel 31 in A-phase, B-phase, and C-phase at this time is illustrated in FIG. 10. Here, it is assumed that the large droplet waveform PA illustrated in FIG. 3(*a*) is generated by using the differential waveform illustrated in FIG. 5 so as to discharge the large droplet and the small droplet waveform PB illustrated in FIG. 3(*b*) is generated by using the differential waveform illustrated in FIG. 6 so as to discharge the small droplet, and a case in which an ink droplet is discharged in the order of B-phase channel (large droplet)->C-phase channel (small droplet)->A-phase channel (large droplet) is illustrated.

The driving waveform for discharging the large droplet and the small droplet by the differential waveform, respectively, is created in every pixel cycle T by selecting a PLSTM0 waveform, a PLSTM1 waveform, and a PLSTM2 waveform illustrated in FIG. 10 at the rising of a pulse division signal. The PLSTM0 waveform is a GND waveform maintaining 0 potential for grounding and is a third driving waveform in the present invention. The PLSTM1 waveform is a waveform repeating the 3AL+Von waveform corresponding to the expanding pulse Pa1 of the large droplet waveform PA with a 3AL idle period and is a first driving waveform in the present invention. The PLSTM2 waveform is a waveform repeating the 2AL+Voff waveform corresponding to the contracting pulse Pa2 of the large droplet waveform PA with a 4AL idle period and is a second driving waveform. This PLSTM2 waveform is repeated at timing rising in synchronization with a falling edge of the PLSTM1 waveform and illustrates a case in which discharge from each of the A-phase, B-phase, and C-phase channels is performed sequentially in a period of 6AL (AL=3.0 μs) in 1 pixel cycle T.

The PLSTM2 waveform is set such that timing of a rising edge of the pulse is shifted by 3AL from the rising edge of the pulse of the PLSTM1 waveform and it rises in synchronization with the falling edge of the pulse of the PLSTM1 waveform.

Moreover, the driving voltage V1 of the PLSTM1 waveform and the driving voltage V2 of the PLSTM waveform are in a relationship of $|V1|>|V2|$. As a result, since V2 can use a apparatus with tolerance lower than V1, a circuit for generating V1 can be made inexpensive and small-sized.

The pulse division signal is a timing signal for dividing the PLSTM1 waveform and the PLSTM2 waveform so as to create a small droplet waveform PB and is composed of, in a rising period of a pulse selection gate signal corresponding to 1 pixel cycle T, a first pulse division signal d1 rising in synchronization with a rising edge of the pulse selection gate signal, second and third pulse division signals d2 and d3 rising at 1AL interval from the first pulse division signal d1, and a fourth pulse division signal d4 rising after 2AL from the rising edge of the third pulse division signal d3, or four signals in total.

Figure 7:
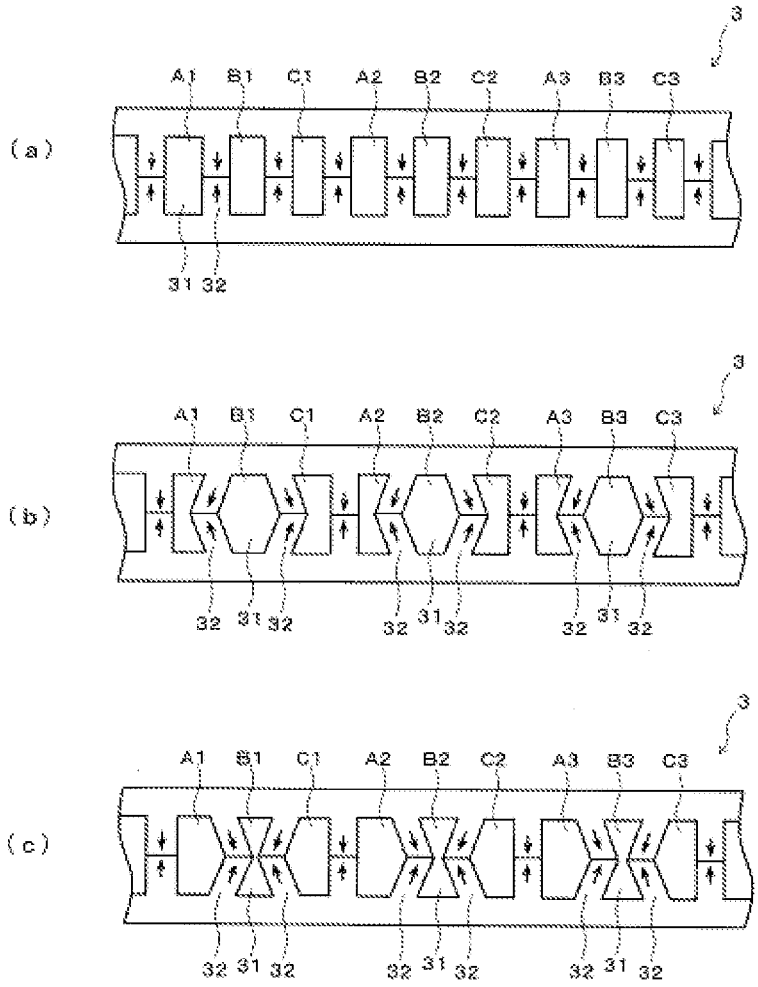
FIG. 7 are explanatory diagrams of the discharging operation during 3-cycle driving.

FIG. 7 illustrate a discharging operation when the large droplet is discharged from the B-phase channel, and first, in the 1 pixel cycle T of the B-phase channel, from the neutral state in FIG. 7(*a*), in synchronization with the rising edge of the first pulse division signal d1 (the rising edge of the pulse selection gate signal of the B-phase channel), the PLSTM2 waveform is selected and applied as illustrated in FIG. 10 to the A-phase channel which becomes the non-discharge channel (A1, A2, and A3) and the C-phase channel (C1, C2, and C3), and the PLSTM1 waveform is selected and applied to the B-phase channel (B1, B2, and B3) which becomes the discharge channel. As a result, the expanding pulse Pa1 of the large droplet waveform PA is generated by the differential waveform between the PLSTM1 waveform and the PLSTM2 waveform, and the B-phase channel has the both partition walls deformed outward as illustrated in FIG. 7(*b*), and the capacity in the channel is expanded.

At timing of the falling edge of the expanding pulse Pa1 included in the PLSTM1 waveform after 3AL has elapsed, the PLSTM2 waveform applied to the A-phase channel and the C-phase channel rises, and the contracting pulse Pa2 having 2AL of the large droplet waveform PA is applied to these A-phase channel and C-phase channel. As a result, the contracting pulse Pa2 of the large droplet waveform PA is generated by the differential waveform between the PSLTM1 waveform and the PLSTM2 waveform, and the B-phase channel has the both partition walls deformed inward as in FIG. 7(*c*), the capacity in the channel is contracted at once, and the large droplet is discharged from each nozzle of the B-phase channel.

After the contracting pulse Pa2 lasts for 2AL, the A-phase channel, the B-phase channel, and the C-phase channel become 0 potential, all the channels return to the neutral state as in FIG. 7(*a*), and the remaining pressure wave is canceled.

Figure 8:
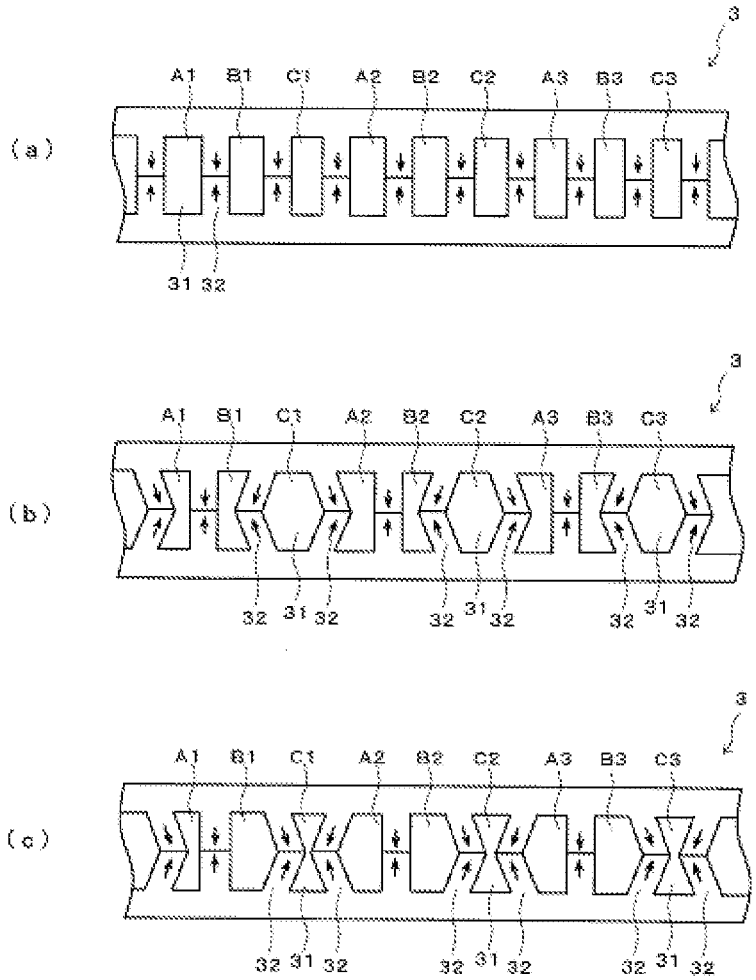
FIG. 8 are explanatory diagrams of the discharging operation during the 3-cycle driving.

Subsequently, FIG. 8 illustrate a discharging operation when the small droplet is discharged from the C-phase, and in the 1 pixel cycle T of the C-phase channel, from the neutral state in FIG. 8(*a*), in synchronization with the rising edge of the first pulse division signal d1 (the rising edge of the pulse selection gate signal of the C-phase channel), the PLSTM2 waveform is selected and applied as illustrated in FIG. 10 to the A-phase channel and the B-phase channel which become the non-discharge channels, and the PLSTM0 waveform is selected and applied to the C-phase channel which becomes the discharge channel. Since all the waveforms are at 0 potential at this time, all the channels maintain the neutral state in FIG. 8(*a*).

Subsequently, in synchronization with the rising edge of the second pulse division signal d2, the PSLTM1 waveform is selected and applied only to the C-phase channel. As a result, by the differential waveform between the PLSTM0 waveform and the PLSTM1 waveform, the B-phase channel has the both partition walls deformed outward as in FIG. 8(*b*), and the capacity in the channel is expanded.

After this application of the PLSTM1 waveform to the C-phase channel is continued for 1AL, when the PLSTM0 waveform is selected again for the C-phase channel at the timing of the rising edge of the third pulse division signal d3, all the channels return to the neutral state in FIG. 8(*a*). As a result, the differential waveform between the PLSTM0 waveform, the PLSTM1 waveform, and the PLSTM2 waveform functions similarly to the expanding pulse Pb1 of the small droplet waveform PB, and the C-phase channel has the both partition walls contracted from the expanded state in FIG. 8(*b*) to the neutral state, and thus, the small droplet is discharged from each nozzle of the C-phase channel.

After 1AL has elapsed since the rising edge of the PLSTM1 waveform applied to the C-phase channel, the PLSTM2 waveform applied to the A-phase channel and the B-phase channel rises. As a result, the differential waveform between the PLSTM1 waveform and the PLSTM2 waveform functions similarly to the contracting pulse Pb2 of the small droplet waveform PB, and the C-phase channel has the both partition walls contracted inward as in FIG. 8(*c*) from the neutral state in FIG. 8(*a*).

After that, by selecting and applying the PLSTM2 waveform to the C-phase channel in synchronization with the rising edge of the fourth pulse division signal d4, the same positive voltage +Voff is applied to all the A-phase channel, B-phase channel, and C-phase channel, and thus, there is no more voltage difference among all the partition walls, and all the channels return to the neutral state in FIG. 8(*a*).

Figure 9:
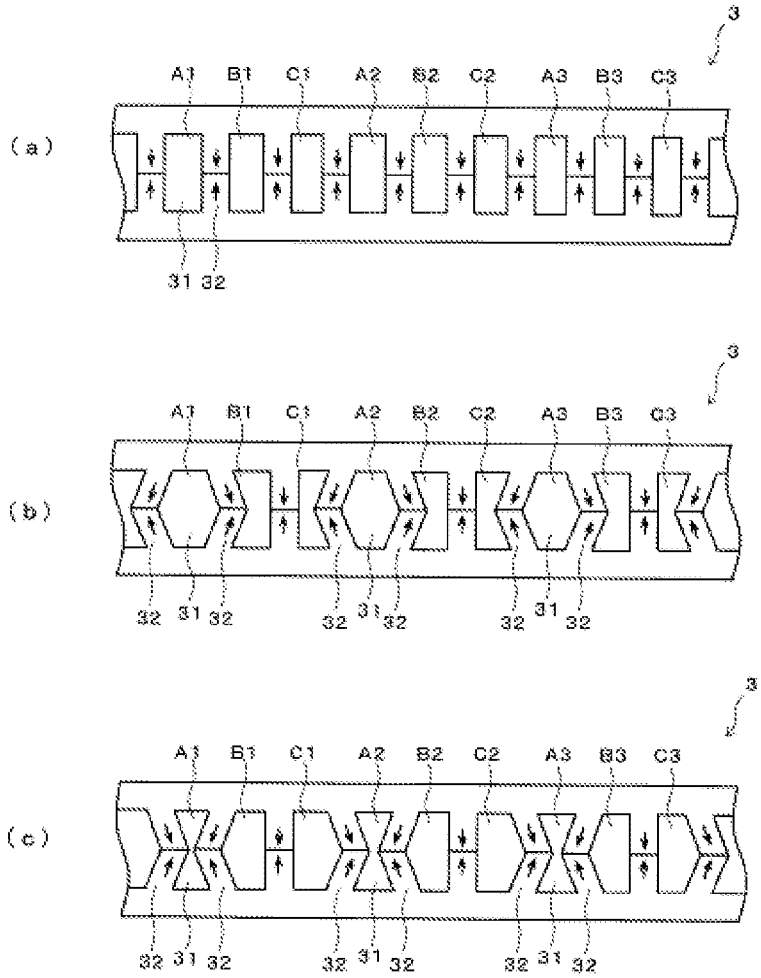
FIG. 9 are explanatory diagrams of the discharging operation during the 3-cycle driving.
Figure 10:
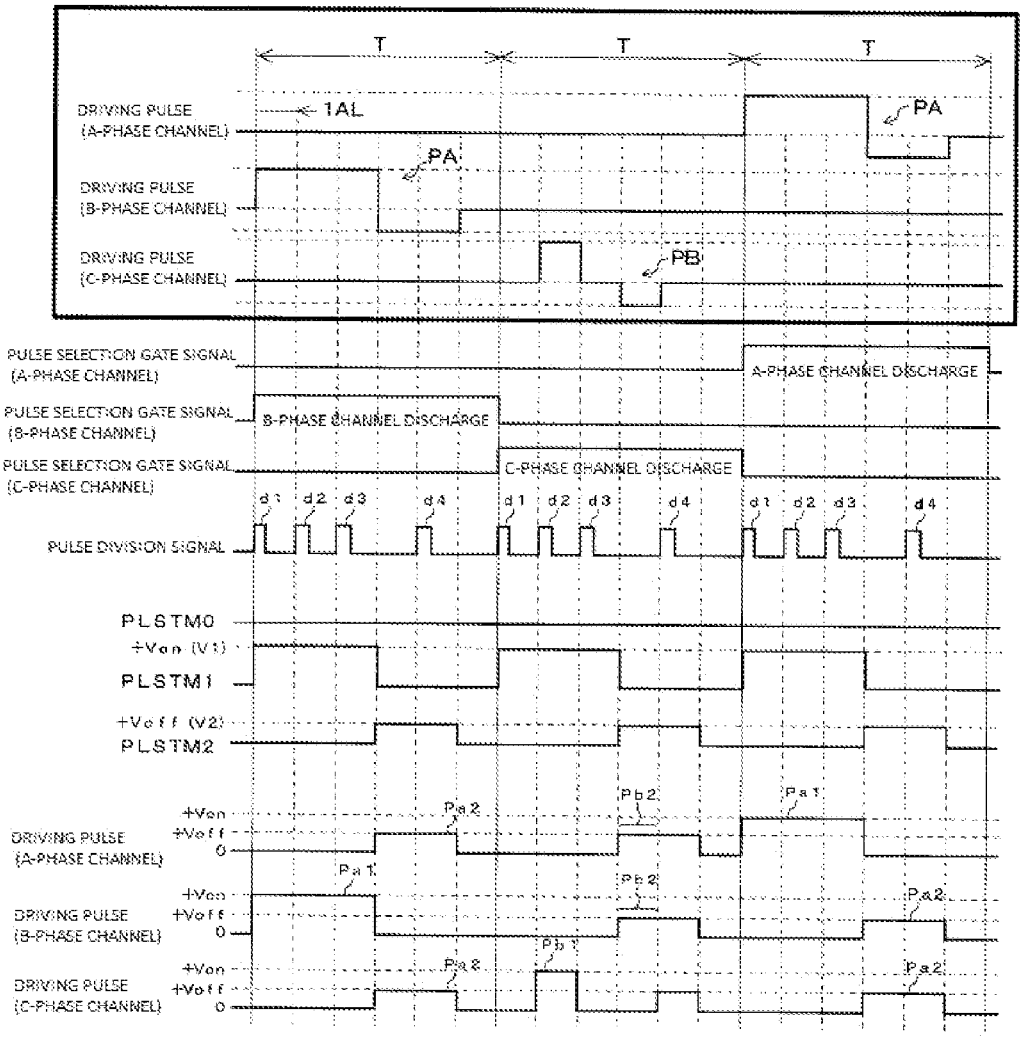
FIG. 10 is a timing chart of the driving waveform applied during the 3-cycle driving.

FIG. 9 illustrate a discharging operation when the large droplet is discharged from the A-phase channel, and in the 1 pixel cycle T of the A-phase channel, from the neutral state in FIG. 9(*a*), in synchronization with the rising edge of the first pulse division signal d1 (the rising edge of the pulse selection gate signal of the A-phase channel), the PLSTM2 waveform is selected and applied as illustrated in FIG. 10 to the B-phase channel and the C-phase channel which become the non-discharge channel, and the PLSTM1 waveform is selected and applied to the A-phase channel which becomes the discharge channel. As a result, by the differential waveform between the PLSTM1 waveform and the PLSTM2 waveform, the expanding pulse Pa1 of the large droplet waveform PA is generated, and the A-phase channel has the both partition walls deformed outward as in FIG. 9(*b*), and the capacity in the channel is expanded.

At timing of the falling edge of the expanding pulse Pa1 included in the PLSTM1 waveform after 3AL has elapsed, the PLSTM2 waveform applied to the B-phase channel and the C-phase channel rises, and the contracting pulse Pa2 having 2AL of the large droplet waveform PA is applied to these B-phase channel and C-phase channel. As a result, the contracting pulse Pa2 of the large droplet waveform PA is generated by the differential waveform between the PSLTM1 waveform and the PLSTM2 waveform, and the A-phase channel has the both partition walls deformed inward as in FIG. 9(*c*), the capacity in the channel is contracted at once, and the large droplet is discharged from each nozzle of the A-phase channel.

After the contracting pulse Pa2 lasts for 2AL, the A-phase channel, the B-phase channel, and the C-phase channel become 0 potential, all the channels return to the neutral state as in FIG. 9(*a*), and the remaining pressure wave is canceled.

The above 3-cycle driving is used in the case where the large droplet is discharged from the A-phase and the B-phase and the small droplet from the C-phase, respectively, but it will be easily understood that any of the phases of A to C can separately inject the large droplet and the small droplet in an arbitrary combination every pixel cycle T by selecting the PLSTM0 waveform, the PLSTM1 waveform, and the PLSTM2 waveform as appropriate.

That is, according to the present invention, even when the large droplet and the small droplet are separately injected from the same nozzle, the three types of the driving waveforms, that is, the PLSTM0 waveform, the PLSTM1 waveform, and the PLSTM2 waveform are commonly used, and in every predetermined time separated by the first pulse division signal d1 to the fourth pulse division signal d4 in 1 pixel cycle T, the PLSTM1 waveform is selected for the driving electrode of the discharge channel and the PLSTM2 waveform is selected for the adjacent driving electrode of the non-discharge channel for discharge of the large droplet, while the PLSTM0 waveform, the PLSTM1 waveform, and the PLSTM2 waveform are switched and selected as appropriate for the driving electrode of the discharge channel and the PLSTM2 waveform is selected for the non-discharge channel for discharge of the small droplet, whereby the partition wall 32 can be operated by the differential waveform between the two driving electrodes.

Moreover, according to the present invention, since required driving waveforms are only three types common for the large droplet and the small droplet, the driving circuit can be simplified.

Moreover, since only either of the large droplet waveform or the small droplet waveform is generated in 1 pixel cycle T, it is not necessary to provide time for a waveform not used in 1 pixel cycle T as before. Thus, the driving cycle does not become wastefully long but an image with improved gradation can be printed at a high speed.

Accordingly, in the present invention, by selecting and using separate driving waveforms from a plurality of types of driving waveforms having different shapes for two driving electrodes for the operating pressure generating unit, respectively, for every predetermined time every pixel cycle so that the pressure generating unit is operated by its differential waveform, an ink-jet recording apparatus capable of discharging dots having different sizes in every pixel cycle with a simple driving circuit configuration without a wastefully long driving cycle can be provided.

Subsequently, an example of an internal configuration of the driving signal generating unit 100 which executes control of separately injecting the large droplet and the small droplet by using the differential waveform by selecting from the three types of driving waveforms every predetermined time in 1 pixel cycle T as appropriate will be described by referring to FIG. 11.

Figures 11, 12:
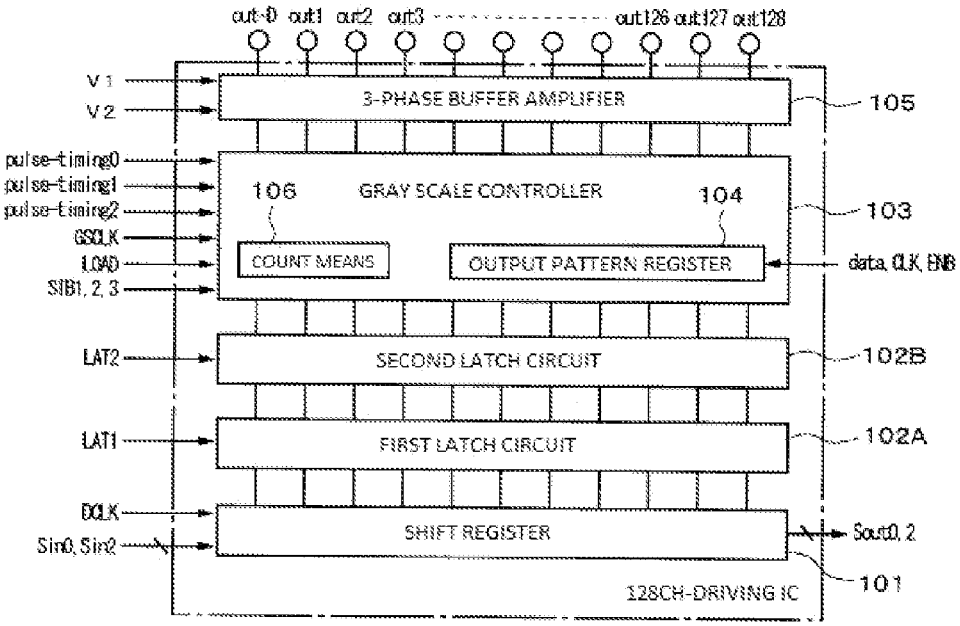
FIG. 11 is a diagram for explaining an internal configuration of a driving signal generating unit.
FIG. 12 is a diagram illustrating an example of a conversion table of image data and driving waveform pattern data.
Figure 13:
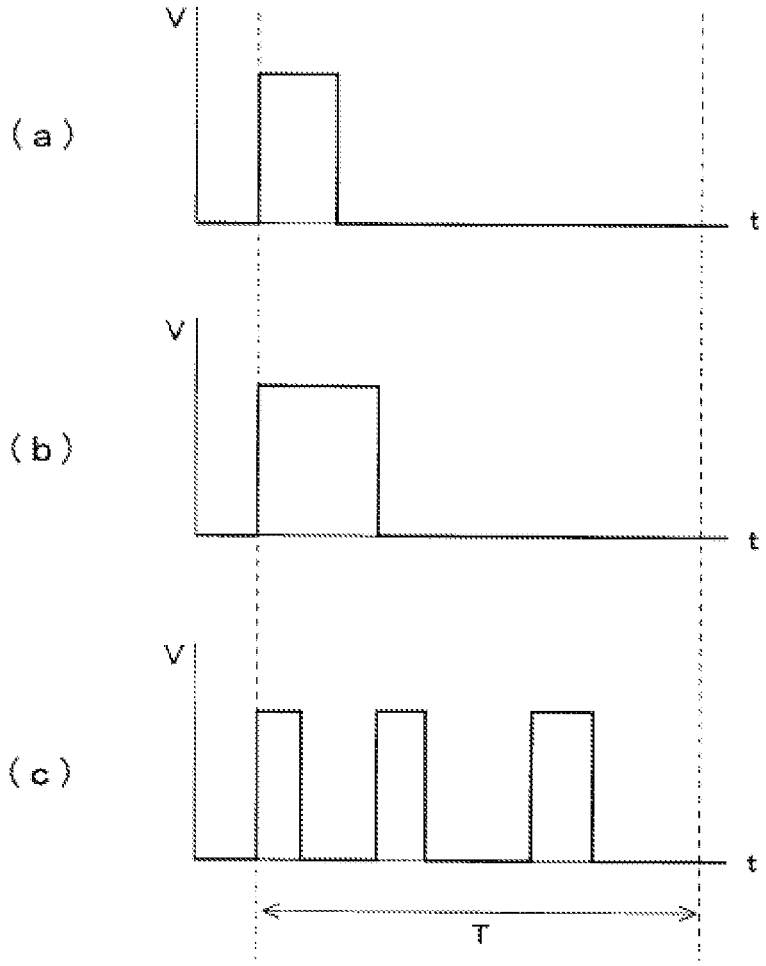
FIG. 13 are diagrams illustrating prior-art driving waveforms.
Figure 14:
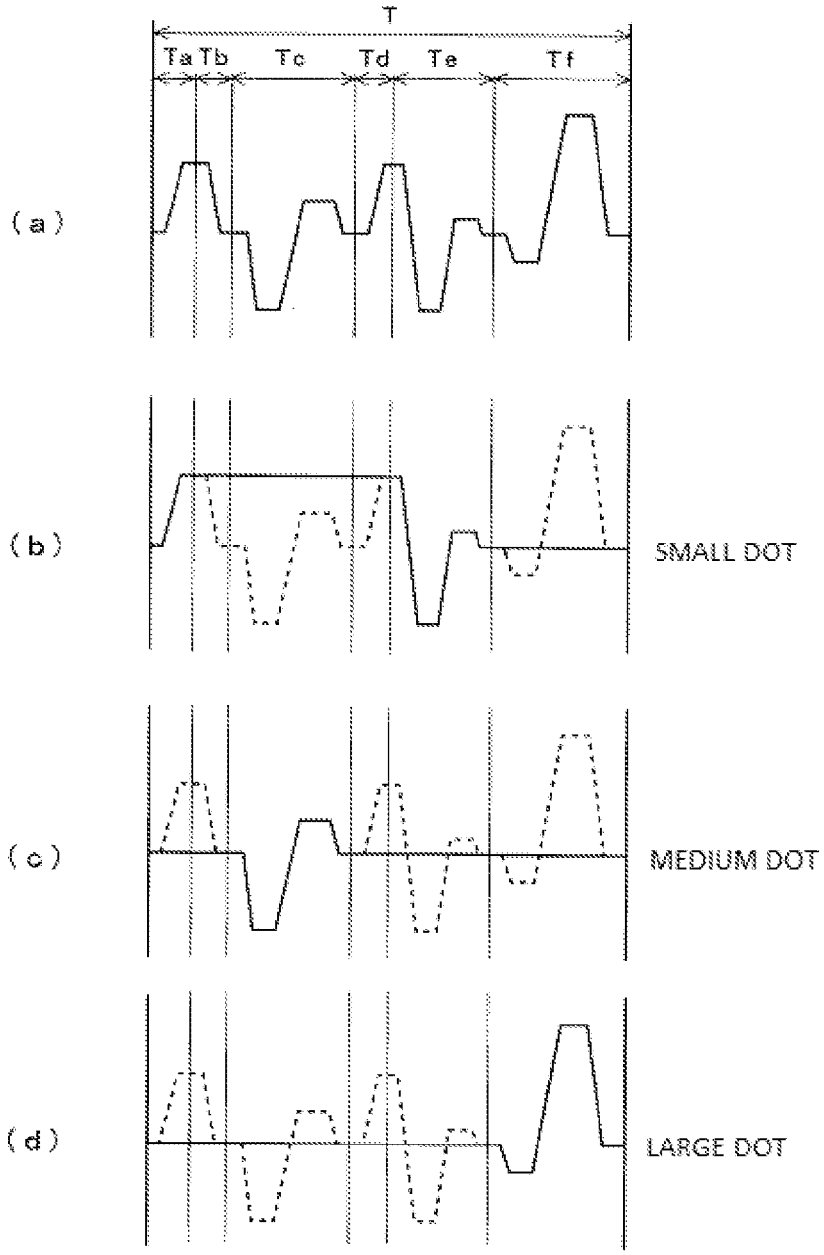
FIG. 14 are diagrams illustrating prior-art driving waveforms.

The driving signal generating unit 100 illustrated in FIG. 11 illustrates a case of a driving IC of 128 channels and includes a first latch circuit 102A of 2 bits×128 channels (nozzle) which is a first latch unit, a second latch circuit 102B of 2 bits×128 channels (nozzle) which is a second latch unit, a shift register 101 which is a first storage unit for outputting image data (discharge data) to the first latch circuit 102A, a gray scale controller 103 for driving the partition wall 32, which is the pressure generating unit for discharging a large droplet or a small droplet on the basis of the discharge data, an output pattern register 104 which is a second storage unit, a three-phase buffer amplifier 10 and the like. As the second storage unit, a register such as the output pattern register 104 is preferably used.

This embodiment has a configuration supporting 2 bits in order to process image data composed of 3 gradations of 0 to 2 (0=non-discharge, 1=small droplet, 2=large droplet) per pixel. In synchronization with a transfer clock DCLK inputted from a control circuit, not shown, image data having 1 pixel composed of 2 bits is transferred to the shift register 101 serially by the unit of pixel. This transfer timing is common for the nozzle rows.

The shift register 101 has a capacity capable of storing image data of the number of pixels corresponding to one session of discharge of 128 nozzles. By connecting two of the shift register 101, image data for 256 pixels corresponding to one row of nozzles juxtaposed in the vertical scanning direction is stored in this embodiment. When a carriage on which the recording head 3 is mounted reaches a predetermined position, the control circuit outputs a LAT1 signal which is a first trigger signal instructing latch timing, and when the first latch circuit 102A receives this LAT1 signal, it latches the image data outputted in parallel from the shift register 101.

When the carriage on which the recording head 3 is mounted reaches the predetermined position, the control circuit outputs a LAT2 signal which is a second trigger signal instructing the latch timing, and when the second latch circuit 102B receives this LAT2 signal, it latches the image data outputted in parallel form the first latch circuit 102A.

As described above, the image data outputted from the shift register 101 goes through the first latch circuit 102A and is latched by the second latch circuit 102B.

When the recording head 3 reaches a position suitable for recording, the control circuit outputs a TRGIN signal for starting ink discharge, and when the second latch circuit 102B receives this TRGIN signal, the image data latched by the second latch circuit 102B is outputted to the gray scale controller 103.

As described above, by providing the two latch units, without improving the data transfer speed more than necessary or without lowing the recording speed, data transfer to the shift registers of the plurality of driving circuits corresponding to the plurality of nozzle rows can be performed at the same time, and trigger processing of data transfer can be executed efficiently. Moreover, the configuration of the control system can be simplified, and a landed position of a droplet of each nozzle row can be adjusted more finely than a pixel pitch.

Into the gray scale controller 103, the three types of driving waveforms (above-described PLSTM0, PLSTM1, and PLSTM2) are inputted through an input terminal from a circuit, not shown, for generating the driving waveform.

Moreover, the gray scale controller 103 constitutes a control unit for sequentially dividing and driving the partition wall which is the corresponding pressure generating unit by 3-cycle driving by dividing all the channels corresponding to 256 nozzles into three sets of A-phase, B-phase, and C-phase, here, as illustrated in FIG. 10, by selection signals (the above-described pulse selection gate signals) STB-1, 2, and 3 supplied from the input terminal. The A-phase is selected by STB-1, the B-phase is selected by STB-2, and the C-phase is selected by STB-3, and the ink droplet is discharged sequentially from the respective corresponding nozzles.

Moreover, the gray scale controller 103 has a count unit 106 for counting the order of the waveform to be outputted in the driving waveform pattern, and GSC (gray scale count) which is a count value of this count unit 106 is counted from 0 to 4.

Moreover, the gray scale controller 103 has an output pattern register 104 which stores a conversion table which is information specifying a relationship between the image data as discharge data and the driving waveform pattern data corresponding to the driving waveform for driving the partition wall which is the pressure generating unit. In this embodiment, the driving waveform pattern data corresponding to the plurality of driving waveforms is illustrated.

First, the count unit is rest by an inputted LOAD signal. The STB-1 is selected, for example, and the A-phase channel (nozzle) is selected. From the image data corresponding to each channel in the A-phase, driving waveform pattern data is determined by the conversion table stored in the output pattern register 104. For the B-phase and C-phase channels which are not driven, predetermined driving waveform pattern data is selected. The GSC which is a count value of the count unit is counted up by 1 from 0, and the driving waveform to be outputted is determined. The driving waveform is selected from the three types of driving waveform, that is, the PLSTM0 waveform, the PLSTM1 waveform, and the PLSTM2 waveform in accordance with the image data and the count value of the count unit. These waveforms are synchronized with the inputted timing signal of GSCLK, selected by the switching unit (not shown) from the above-described three types of driving waveforms and outputted.

A 3-phase buffer amplifier 105 level-shifts the driving waveform outputted from the gray scale controller 103 to a supply voltage required for driving of the partition wall. At this time, the driving voltage with +Von of the driving waveform is determined by the voltage value V1 inputted from the input terminal and the driving voltage with +Voff of the driving waveform is determined by the voltage value V2 inputted similarly, and they are level-shifted, respectively, and then, outputted to the driving electrode of the corresponding partition wall and the ink droplet is discharged from the corresponding nozzle. By changing the voltage values of V1 and V2, the driving voltage can be changed to an optimal value.

When the count value of the count unit reaches GSC=4, it is determined that discharge of the ink droplet from the A-phase channel is finished, the count unit 106 is reset by the LOAD signal, and then, the B-phase is selected by the STB-2 signal, and the ink droplet is discharged similarly for the B-phase. When the B-phase is finished, the ink discharge is performed similarly for the C-phase. Then, the ink discharge for all the nozzles for 1 row is finished, and recording is repeated again on the basis of the subsequent image data.

FIG. 12 is a diagram illustrating an example of a conversion table of the image data and the driving waveform pattern data.

The image data is expressed in 3 gradations by a gradation value 0 (non-discharge), a gradation value 1 (small droplet), and a gradation value 2 (large droplet).

The driving waveform pattern data has the above-described 3 types, that is, PLSTM0 to 2 and corresponds to the five states of the count value of the above-described count unit GSC=0 to 4. The driving waveform pattern data "0" indicates that the PLSTM0 is selected, "1" for PLSTM1, and "2" for PLSTM2, respectively.

Moreover, since the data is outputted from a bit located afterward, in the case of the gradation value 1 in the table in FIG. 12, for example, the driving waveform pattern data of (2, 0, 1, 0, 0) is selected, and the driving waveform pattern data of (0, 0, 1, 0, 2) is outputted. The outputted driving waveform pattern corresponds to the above-described count value GSC=0 to 4, and in this case, if the count value of the above-described count unit is GSC=0, 0 is outputted as the driving waveform data to be selected, if the count value is GSC=1, 0 is outputted, if the count value GSC=2, 1 is outputted, if the count value is GSC=3, 0 is inputted, and if the count value GSC=4, 2 is outputted, respectively.

The count value GSC=1 to 4 correspond to the above-described pulse division signals d1 to d4.

As described above, the STB signal is obtained by dividing the channel corresponding to the 256 nozzles into three phases of A, B, and C in accordance with the three division signals of STB-1, STB-2, and STB-3 so as to sequentially divide and drive the corresponding partition wall.

In the example of the timing chart illustrated in FIG. 10, for example, first, the partition wall of the B-phase channel is driven at n=2 and a large droplet with the gradation value 2 is discharged, but in this case, the driving waveform pattern data of (1, 1, 1, 1, 0) in the table in FIG. 12 is selected for the B-phase channel, and (0, 1, 1, 1, 1) is outputted. On the other hand, for the A-phase and C-phase channels applicable to n=1 and 3, the driving waveform pattern data of (2, 2, 2, 2, 0) is selected regardless of the image data, and (0, 2, 2, 2, 2) is outputted.

As a result, as illustrated in FIG. 10, regarding the B-phase channel which is a discharge channel, only the PLSTM1 is selected in each period divided by the pulse division signals d1 to d4 in 1 pixel cycle T, while regarding the A-phase and C-phase channels which are non-discharge channels, only the PLSTM2 is selected in each period divided by the pulse division signals d1 to d4 in 1 pixel cycle T.

Subsequently, at n=3, the partition wall of the C-phase channel is driven so as to discharge the small droplet with the gradation value 1, but in this case, for the C-phase channel, the driving waveform pattern data of (2, 0, 1, 0, 0) in the table in FIG. 12 is selected, and (0, 0, 1, 2, 2) is outputted. On the other hand, for the A-phase and B-phase channels corresponding to n=1 and 2, the driving waveform pattern data of (2, 2, 2, 2, 0) is selected regardless of the image data and (0, 2, 2, 2, 2) is outputted.

As a result, as illustrated in FIG. 10, regarding the C-phase channel which is a discharge channel, the PLSTM0 is selected in the period divided by the pulse division signal d1 in 1 pixel cycle T, the PLSTM1 is selected in the period divided by the pulse division signal d2, the PLSTM0 is selected in the period divided by the pulse division signal d3, and the PLSTM2 is selected in the period divided by the pulse division signal d4, while regarding the A-phase and B-phase channels which are non-discharge channels, only the PLSTM2 is selected in each period divided by the pulse division signals d1 to d4 in 1 pixel cycle T.

Subsequently, at n=1, the partition wall of the A-phase channel is driven so as to discharge the large droplet with the gradation value 1, but in this case, for the A-phase channel, the driving waveform pattern data of (1, 1, 1, 1, 0) in the table in FIG. 12 is selected, and (0, 1, 1, 1, 1) is outputted. On the other hand, for the B-phase and C-phase channels corresponding to n=2 and 3, the driving waveform pattern data of (2, 2, 2, 2, 0) is selected regardless of the image data and (0, 2, 2, 2, 2) is outputted.

As a result, as illustrated in FIG. 10, regarding the A-phase channel which is a discharge channel, only the PLSTM1 is selected in each period divided by the pulse division signals d1 to d4 in 1 pixel cycle T, while regarding the B-phase and C-phase channels which are non-discharge channels, only the PLSTM2 is selected in each period divided by the pulse division signals d1 to d4 in 1 pixel cycle T.

Therefore, in a state where the count value of the count unit is GSC=0, the driving waveform data of 0 is selected for all the channels in the A-phase, B-phase, and C-phase, and the partition wall is not driven, but with GSC=1 to 4, the partition wall is driven as described above in accordance with the driving waveform data.

Moreover, in the case of the recording head having 256 channels for performing ink discharge, since it is necessary to deform the both partition walls of two channels arranged on the both ends thereof, a dummy channel not discharging an ink droplet is further arranged each on the both end sides thereof in addition to these 256 channels, and the driving waveform pattern data of (2, 2, 2, 2, 0) is selected as out-D for the driving electrode of this dummy channel, and (0, 2, 2, 2, 2) is outputted. As a result, the partition wall of the dummy channel is driven in accordance with the driving waveform applied to the electrode in accordance with the image data of the channels on the both ends of the 256 channels.

As described above, since the driving signal generating unit 100 of the driving circuit has the shift register 101 which is the first storage unit for storing discharge data, and the output pattern register 104 which is the second storage unit for storing the information specifying the relationship between the discharge data and the driving patterns corresponding to the first driving waveform (PLSTM1), the second driving waveform (PLSTM2), and the third driving waveform (PLSTM0) for operating the pressure generating unit, the driving waveform selected at each predetermined time in 1 pixel cycle can be rapidly switched and applied to the pressure generating unit.

The output pattern register 104 which is the second storage unit is preferably rewritable. The term rewritable unit that contents can be changed as necessary from a control unit or the like for controlling the ink-jet recording apparatus, not shown, and as a result, separate injection can be similarly realized in the driving waveform other than the driving waveforms illustrated in this embodiment by rewriting the contents of the register.

The entire disclosure of Japanese Patent Application No. 2012-58004, filed on Mar. 14, 2012 including description, claims, drawing, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

EXPLANATION OF LETTERS OF NUMERALS

1 ink-jet recording apparatus
2 conveying mechanism
  21 conveying roller
  22 pair of conveying rollers
  23 conveying motor
3 recording head
  30 channel substrate
  31 channel
  32 partition wall
  32*a* upper wall portion
  32*b* lower wall portion
  33 cover substrate
  33*a* common channel
  34 nozzle plate
  34*a* nozzle
  35 plate
  35*a* ink supply opening
  35*b* ink supply pipe
4 guide rail
5 carriage
6 flexible cable
100 driving signal generating unit
101 shift register (first storage unit)
102A first latch circuit
102B second latch circuit
103 gray scale controller
104 output pattern register (second storage unit)
105 3-phase buffer amplifier
P recording medium
PS recording surface
PA large droplet waveform
  Pa1 expanding pulse
  Pa2 contracting pulse
PB small droplet waveform
  Pb1 expanding pulse
  Pb2 contracting pulse
  Pb3 idle period

The invention claimed is:

1. An ink-jet recording apparatus comprising:

a recording head that includes: (i) a plurality of nozzles for discharging ink droplets, (ii) a pressure chamber communicating with each of the plurality of nozzles, and (iii)

a pressure generating unit which has a piezoelectric material sandwiched between two driving electrodes and which is operated by application of a driving waveform to each of the two driving electrodes based on a plurality of pieces of discharge data so as to change a capacity of the pressure chamber and to discharge ink in the pressure chamber from a corresponding nozzle, wherein the plurality of pieces of discharge data includes discharge data for discharging a relatively large ink droplet from the nozzle and discharge data for discharging a relatively small ink droplet from the nozzle; and a driving circuit that generates the driving waveform, wherein the driving waveform includes a first driving waveform composed of non-GND waveform, a second driving waveform composed of a non-GND waveform different from the first driving waveform, and a third driving waveform composed of a GND waveform, wherein a relation between a driving voltage V1 of the first driving waveform and a driving voltage V2 of the second driving waveform is $|V1|>|V2|$; and wherein the driving circuit selects at least the first driving waveform and the second driving waveform or only the first driving waveform at every predetermined time shorter than 1 pixel cycle in accordance with each of the plurality of pieces of discharge data, applies this to one of the two driving electrodes of the pressure generating unit and also selects and applies only the second driving waveform to the other of the two driving electrodes so as to operate the pressure generating unit by a differential waveform between the two driving electrodes.

2. The ink-jet recording apparatus according to claim 1, wherein the driving circuit has a first storage unit for storing the plurality of pieces of discharge data and a second storage unit for storing information specifying a relationship between the plurality of pieces of discharge data and a driving pattern corresponding to the first driving waveform, the second driving waveform, and the third driving waveform for operating the pressure generating unit.

3. The ink-jet recording apparatus according to claim 2, wherein the second storage unit is rewritable.

4. The ink-jet recording apparatus according to claim 1, wherein the first driving waveform and the second driving waveform are both rectangular waves.

5. The ink-jet recording apparatus according to claim 1, wherein the recording head is a shear-mode type recording head having a common partition wall made of the piezoelectric material between adjacent pressure chambers, wherein each driving electrode is formed on a surface of the partition wall facing a pressure chamber, and wherein shear deformation is performed by the partition wall as the pressure generating unit.

6. The ink-jet recording apparatus according to claim 5, wherein the plurality of the pressure chambers are grouped into a plurality of sets, such that one set is composed of mutually adjacent three pressure chambers, and the partition wall is subjected to shear deformation so that the three pressure chambers in each set are sequentially driven in a time division manner.

* * * * *